US012498190B2

(12) United States Patent
Bae

(10) Patent No.: US 12,498,190 B2
(45) Date of Patent: Dec. 16, 2025

(54) DRUM-TYPE MAGAZINE USED IN SMALL FIREARM

(71) Applicant: Young K Leigh, Chantilly, VA (US)

(72) Inventor: Ju Hwan Bae, Incheon (KR)

(73) Assignee: Young K Leigh, Chantilly, VA (US)

( * ) Notice: Subject to any disclaimer, the term of this patent is extended or adjusted under 35 U.S.C. 154(b) by 0 days.

(21) Appl. No.: 18/976,304

(22) Filed: Dec. 10, 2024

(65) Prior Publication Data

US 2025/0369713 A1 Dec. 4, 2025

(30) Foreign Application Priority Data

Jun. 3, 2024 (KR) ..... 10-2024-0072369

(51) Int. Cl.
*F41A 9/73* (2006.01)
*F41A 9/82* (2006.01)

(52) U.S. Cl.
CPC . *F41A 9/73* (2013.01); *F41A 9/82* (2013.01)

(58) Field of Classification Search
CPC ..... F41A 9/26; F41A 9/73; F41A 9/74; F41A 9/75
See application file for complete search history.

(56) References Cited

U.S. PATENT DOCUMENTS 4,658,700 A * 4/1987 Sullivan ..... F41A 9/73 89/33.02
5,456,153 A * 10/1995 Bentley ..... F41A 9/73 89/33.17

(Continued)

FOREIGN PATENT DOCUMENTS

CH 168477 A * 4/1934
KR 20180128572 A * 12/2018 ..... F41A 9/73

(Continued)

*Primary Examiner* — Gabriel J. Klein
(74) *Attorney, Agent, or Firm* — SZDC Law PC

(57) ABSTRACT

The present invention relates to a drum-type magazine used in a small firearm. The drum-type magazine includes: a housing which includes a rear cover having an insertion space formed at the central portion, a pair of bullet guide parts formed below the insertion space, and a first storage space and a second storage space formed on both sides facing each other around the insertion space, and a front cover coupled in front of the rear cover; an insertion part inserted into the insertion space; a pair of bullet-moving members, each of which is rotatably installed with elastic force on a rotational shaft formed at the center of the first storage space and the second storage space and has seating grooves sequentially formed on the outer circumference thereof; and an operation member including a lifting portion having an operation lever, a long-hole bracket installed at a lower portion of the lifting portion, an operation rod of which one side is rotatably connected to the long-hole bracket and the other side is rotatably connected to the rotational shaft with elastic force to be rotated depending on the ascending of the lifting portion, and an operation portion installed inside an extended portion of the other side of the operation rod, rotatably installed at a predetermined angle with elastic force and pushing the an operation protrusion of the bullet-moving member to rotate the bullet-moving member in the clockwise direction.

9 Claims, 12 Drawing Sheets

(56) References Cited

U.S. PATENT DOCUMENTS

| | | | | |
|---|---|---|---|---|
| 5,905,224 | A * | 5/1999 | Jordan | F41A 9/75 89/33.02 |
| 8,485,083 | B1 * | 7/2013 | Care | F41A 9/75 89/33.02 |
| 10,088,258 | B1 * | 10/2018 | Leigh | F41A 9/73 |
| 2007/0107592 | A1 * | 5/2007 | Snow | F41A 9/68 89/33.02 |
| 2012/0227300 | A1 * | 9/2012 | Seeley | F41A 9/70 42/49.02 |
| 2014/0251119 | A1 * | 9/2014 | Macy | F41A 9/73 89/33.02 |
| 2018/0202749 | A1 * | 7/2018 | Sullivan | F41A 9/77 |

FOREIGN PATENT DOCUMENTS

| | | | | |
|---|---|---|---|---|
| KR | 101942183 | B1 * | 1/2019 | F41A 9/68 |
| KR | 102065856 | B1 | 1/2020 | |

* cited by examiner

DRUM-TYPE MAGAZINE USED IN SMALL FIREARM

This application claims priority to Republic of Korea Patent Application No. KR 10-2024-0072369, filed on Jun. 3, 2024, which is incorporated by reference for all purposes as if fully set forth herein.

BACKGROUND OF THE INVENTION

Field of the Invention

The present invention relates to a drum-type magazine used for supplying bullets to a firearm, and more specifically, to a drum-type magazine used in a small firearm which can simply and rapidly supply bullets to a drum-type magazine.

Background Art

In general, a hammer of a firearm strikes a firing pin connected to a bolt by pulling a trigger, and the firing pin strikes a detonator, which is the rear of a bullet engaged with a bolt carrier, so the bullet is fired through a barrel connected to the front of a firearm body by the explosion force generated by the explosion of gunpowder, ad the bolt carrier is retreated by the gas pressure generated during the explosion and drags and ejects the cartridge case out.

Moreover, the bolt carrier moves forward again, drags the bullet supplied from the magazine into a chamber. The firing pin connected to the bolt is returned to the pre-strike position, thereby preparing for the hammering action by the next triggering action.

Meanwhile, the magazine (cartridge) is a container designed to hold bullets and sequentially transfer the bullets to the chamber of the firearm. A spring and a bullet guide device are provided inside the magazine, and the bullets sequentially moved by the guide of the bullet guide device are sent to the chamber through the bolt carrier.

The magazines can be classified into a box-type magazine that bullets are loaded in a linear arrangement, a drum-type magazine that bullets are loaded in a spiral arrangement within the drum, and so on. Compared to the box-type magazine, the drum-type magazine has the advantage of storing a larger quantity of bullets.

However, the conventional drum-type magazine has a disadvantage in that bullets must be individually pushed into an insertion part of the drum-type magazine fit into a bullet fitting part of the firearm, making it cumbersome and time-consuming to load a large number of cartridges.

To overcome the disadvantage, a loader can be used to push the bullets, which are caught to an end of the insertion part of the drum-type cartridge, down to make a space inside the insertion part and put the bullets into the space.

However, to use the loader, there are several disadvantages in that a user must always carry the loader and in that graphite must be additionally used for lubrication during the supply of bullets.

PATENT LITERATURE

Patent Documents

Patent Document 1: Korean Patent No. 10-2065856 (published on Jan. 13, 2020)

SUMMARY OF THE INVENTION

Accordingly, the present invention has been made to solve the above-mentioned problems occurring in the prior arts, and it is an objective of the present invention to provide a drum-type magazine used in a small firearm, which allows bullets to be easily and quickly inserted into an insertion part of the drum-type magazine.

The objectives of the present invention are not limited to those mentioned above, and other objectives not mentioned herein will be clearly understood by those skilled in the art from the following description.

To accomplish the above object, according to the present invention, there is provided a drum-type magazine used in a small firearm including: a housing which includes a rear cover, which has an insertion space formed at the central portion thereof and having an inlet formed upward, a pair of bullet guide parts formed below the insertion space, and a first storage space and a second storage space symmetrically formed on both sides facing each other around the insertion space, and a front cover, which is coupled in front of the rear cover to enclose the insertion space, the first storage space, and the second storage space, and has an operation hole penetrating through the central portion thereof; an insertion part of which open lower end is inserted into the insertion space and connected to the bullet guide part, and which is inserted into a magazine fitting part of the firearm in a state in which bullets are temporarily held to the top of the insertion part; a pair of bullet-moving members, each of which is rotatably installed with elastic force on a rotational shaft formed at the center of the first storage space and the second storage space, has seating grooves sequentially formed along the outer circumference thereof to allow bullets to be seated, and moves the bullets into the insertion part through the bullet guide part by the counterclockwise rotation; and an operation member which includes a lifting portion, which is located in front of the bottom of the insertion part, installed to move up and down, and has an operation lever passing through the operation hole and installed on the front surface thereof, a long-hole bracket, which is installed at a lower portion of the lifting portion 410 and has long holes formed at both facing sides thereof, a pair of operation rods, each of which has one side having a connection pin provided to be rotatably connected to the long hole of the long-hole bracket and the other side rotatably connected to the rotational shaft with elastic force to be rotated depending on the ascending of the lifting portion, and a pair of operation portions, which are installed inside an extended portion of the other end of each operation rod to rotate at a predetermined angle with elastic force, push one of operation protrusions annularly protruding at regular intervals around the rotational shaft on the front surface of the bullet-moving member depending on the descending of the lifting portion to rotate the bullet-moving member in the clockwise direction.

Preferably, a partition wall is installed between the front cover and the rear cover, and through-holes are formed on both facing sides of the partition wall.

More preferably, inside the housing, a plurality of dummy bullets, which extend from the top of the interior of the insertion part to the central bottom of the bullet-moving member through the bullet guide part and are linked together are installed in pairs, in the first storage space and the second storage space, respectively.

More preferably, bullet-moving guides are provided above the spaced bullet guide parts respectively.

More preferably, the operation protrusion protrudes in a cylindrical shape, and the operation portion has an arc-shaped grip groove formed at an end thereof to allow a user to grip the outer periphery of the operation protrusion, and the operation rod has a rotation prevention jaw provided at an end of the extended portion of the other side thereof to prevent excessive rotation of the operation portion.

More preferably, the bullet-moving members are configured as a pair facing each other and spaced apart on the rotational shaft.

More preferably, a dummy bullet support is provided between the pair of bullet-moving members configured as a pair facing each other and spaced apart on the rotational shaft, wherein one end of the dummy bullet support is fixed to the inner surface of one of the pair of bullet-moving members, and the other end extending in an arc shape gets out of the spaced bullet-moving members and is configured to be in a horizontal state.

More preferably, the operation lever is hinge-connected to the front surface of the lifting portion to allow folding and unfolding.

More preferably, the operation lever is folded and unfolded within a range of a right angle, such that when folded upward, the operation lever is positioned toward the front of the insertion part, and when unfolded downward, the operation lever maintains the horizontal state while maintaining a right angle relative to the vertical plane of the lifting portion.

As described above, the drum-type magazine used in the small firearm according to the present invention has the following effects.

The operation means is created below the insertion part of the drum-type magazine, which is fit into the magazine fitting part of the firearm. The operation means moves the bullets stored in the first storage part and the second storage part in the opposite direction of the discharge to make a space at the top of the insertion part which is fit into the magazine fitting part of the firearm, so allows a user to simply and rapidly insert a large number of bullets into the space, thereby enhancing user convenience.

On the other hand, the effects described in the present invention are naturally exhibited by the configuration of the content described, regardless of the inventor's recognition. Therefore, the aforementioned effects should only be considered as some of effects based on the described content and should not be interpreted as encompassing all effects identified or realized by the inventor.

Furthermore, the effects of the present invention should be further understood through the overall description of the specification. Even if not explicitly stated in the text, if a person skilled in the relevant technical field can recognize such effects through the present specification, it should be regarded as effects described in the present specification.

DETAILED DESCRIPTION OF THE PREFERRED EMBODIMENT

Figure 1:
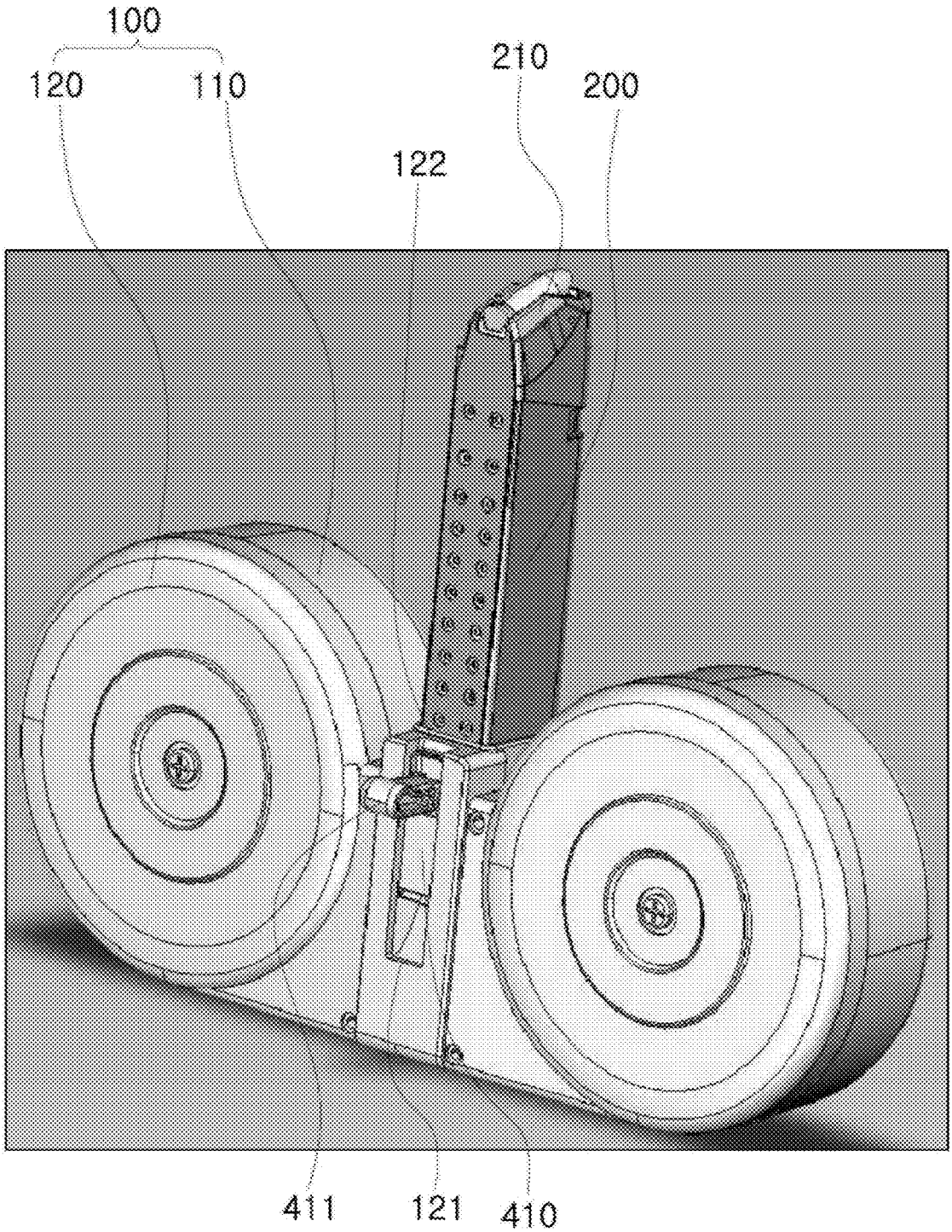
FIG. 1 is a perspective view of an assembled state of a drum-type magazine according to an embodiment of the present invention.
Figure 2:
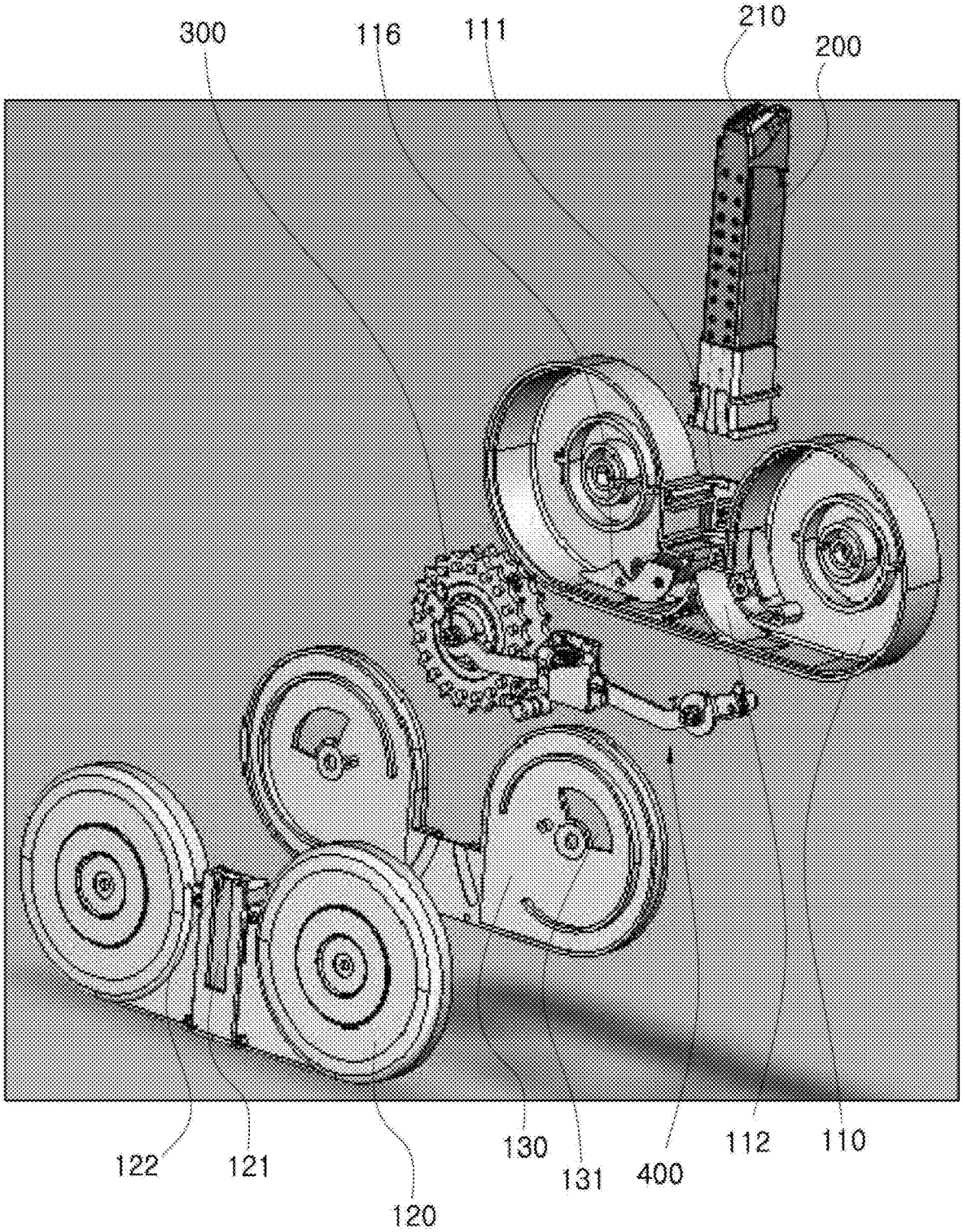
FIG. 2 is a perspective view of a disassembled state of the drum-type magazine according to an embodiment of the present invention.
Figure 3:
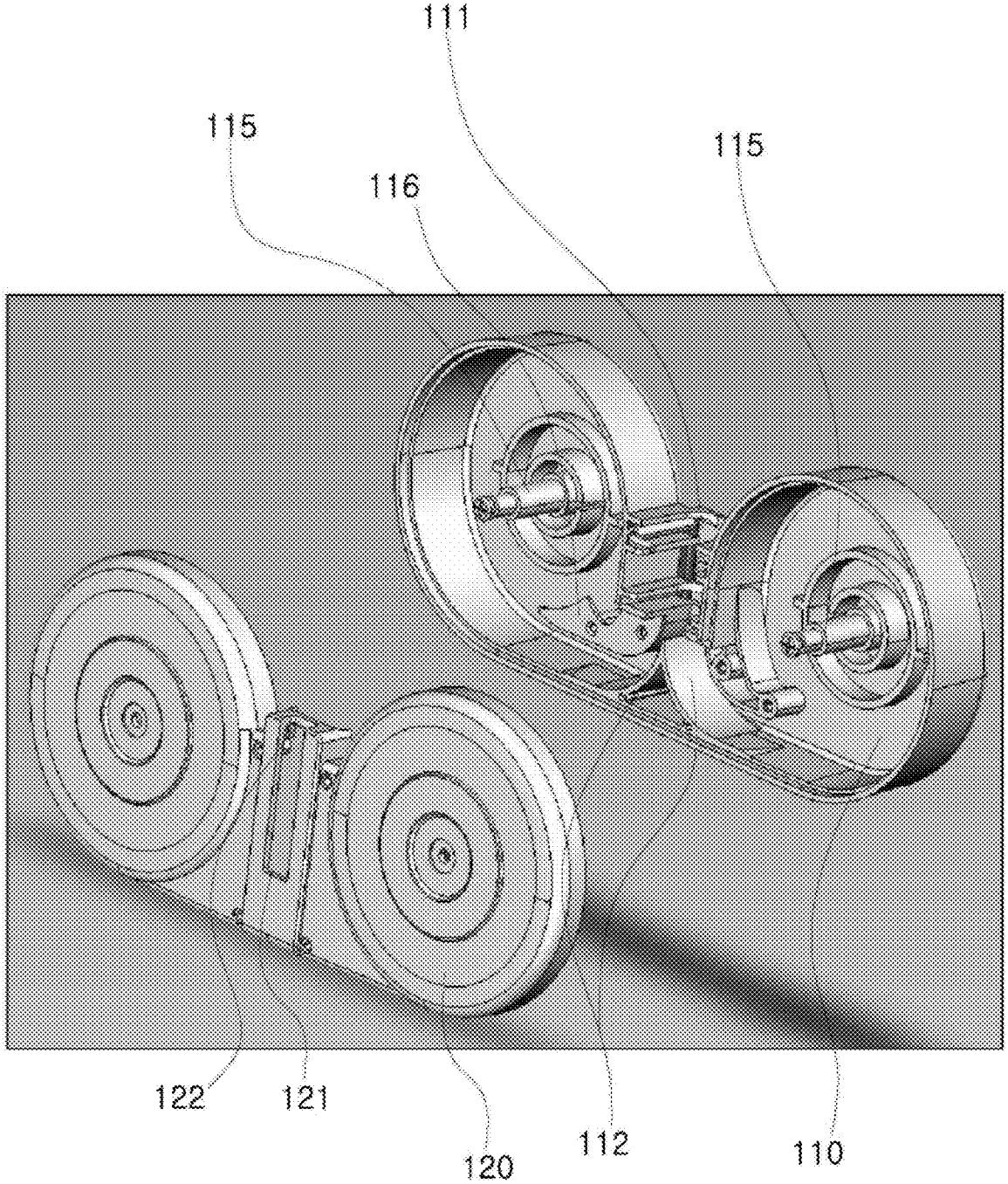
FIG. 3 is a perspective view of a disassembled state of a housing of the drum-type magazine according to an embodiment of the present invention.
Figure 4:
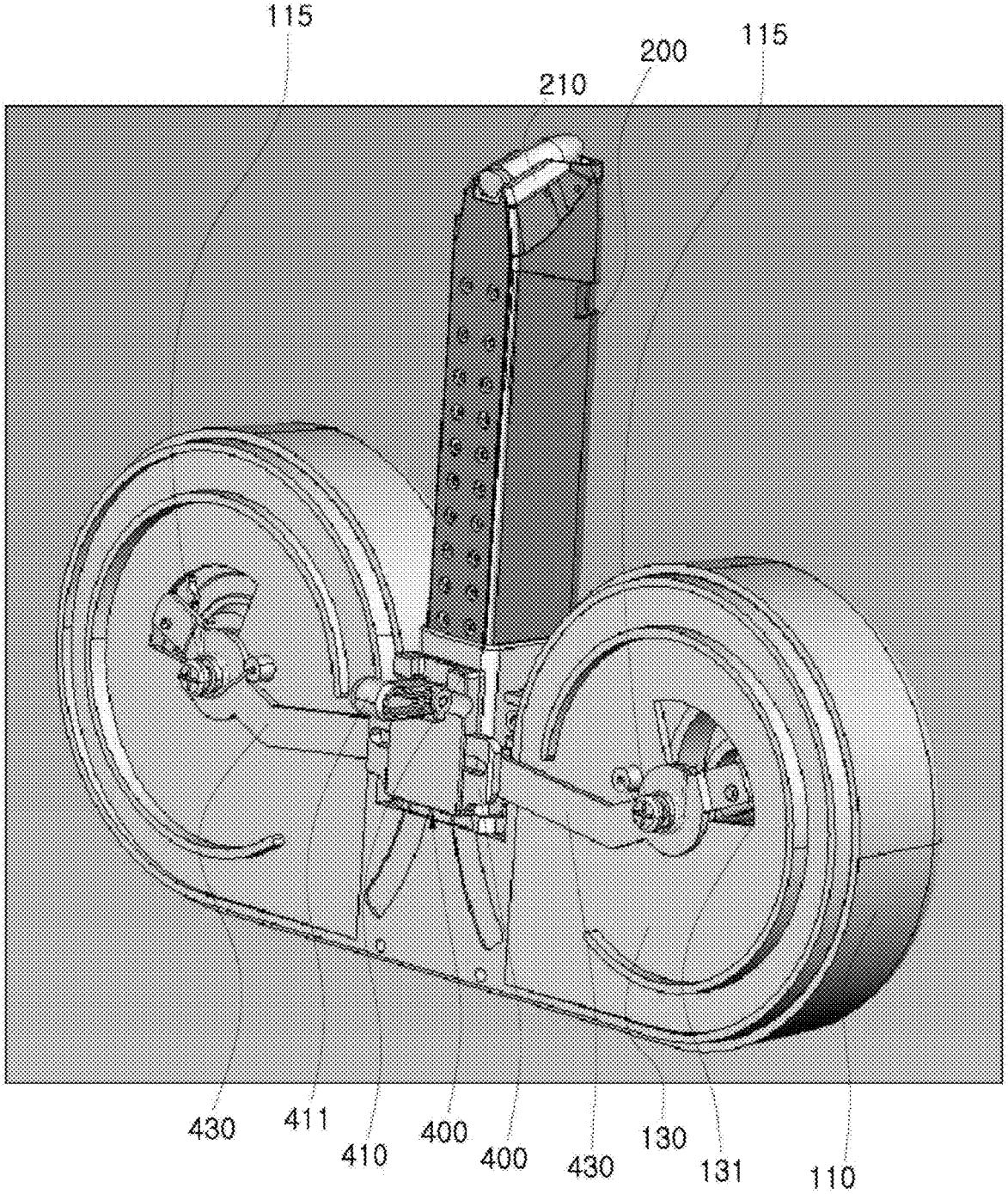
FIG. 4 is a perspective view of a partition installed in the housing of the drum-type magazine according to an embodiment of the present invention.
Figure 5:
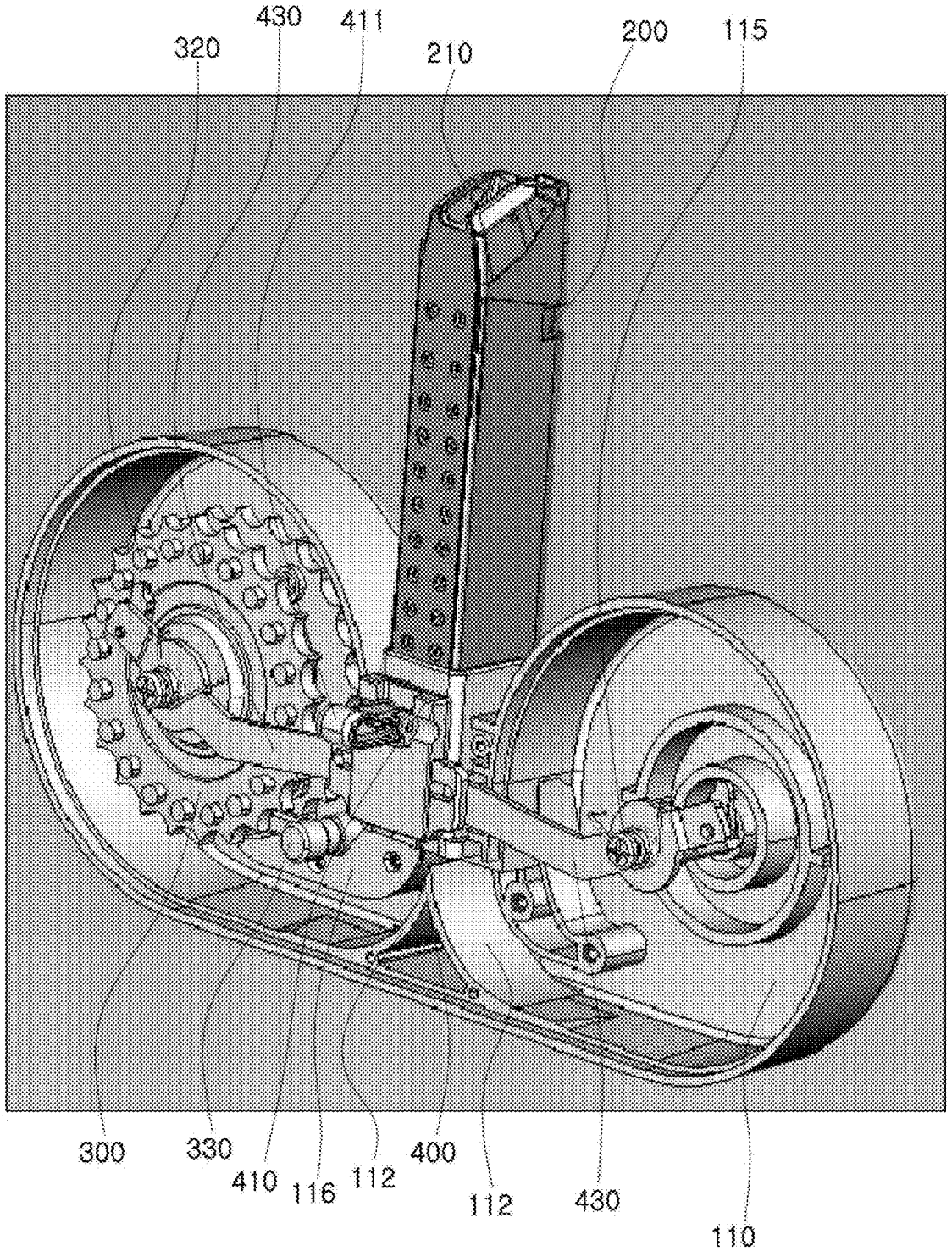
FIG. 5 is a perspective view of the internal components of the housing of the drum-type magazine according to an embodiment of the present invention.
Figure 6:
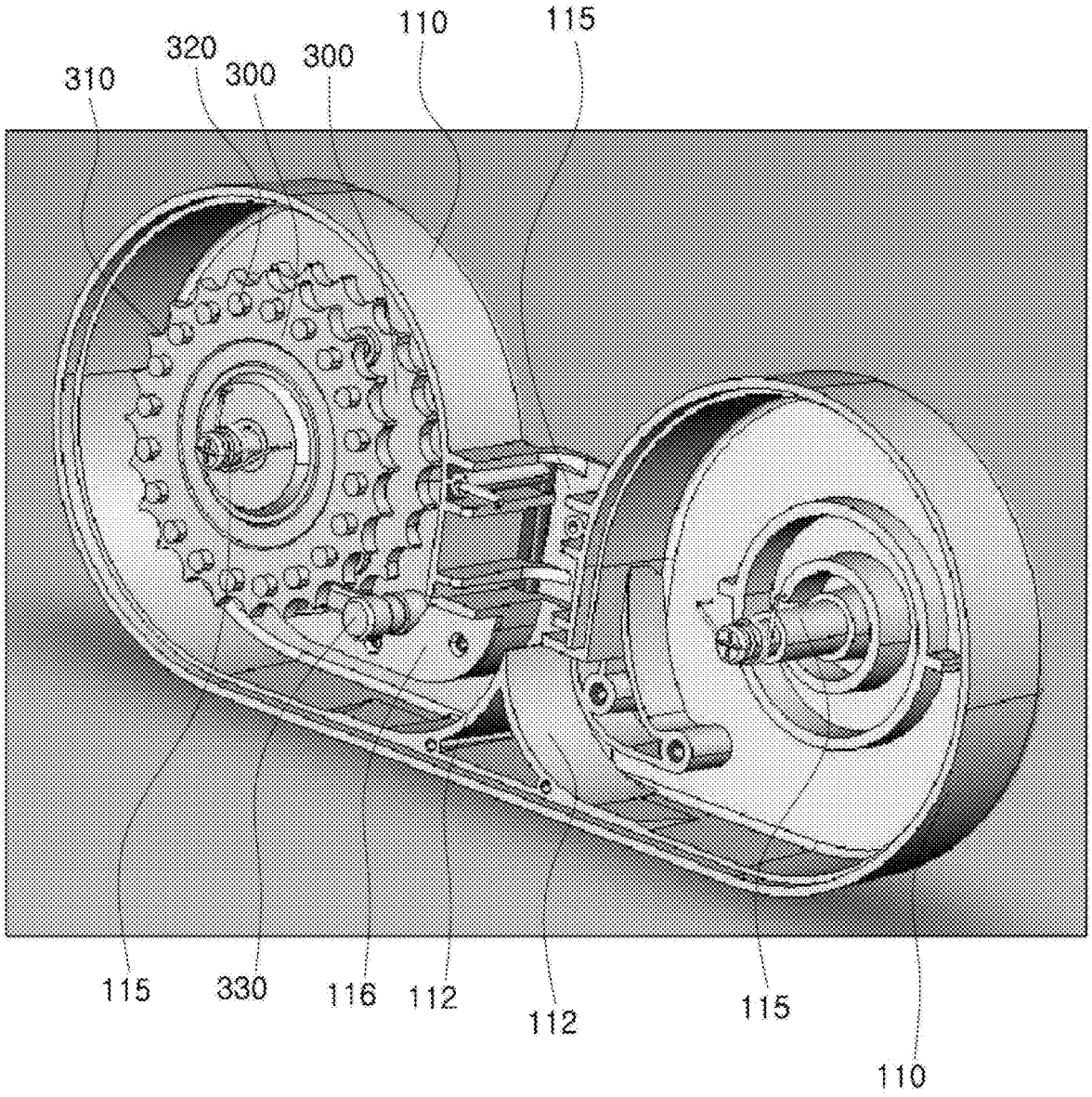
FIG. 6 is a perspective view of a bullet-moving member installed inside the housing of the drum-type magazine according to an embodiment of the present invention.
Figure 7:
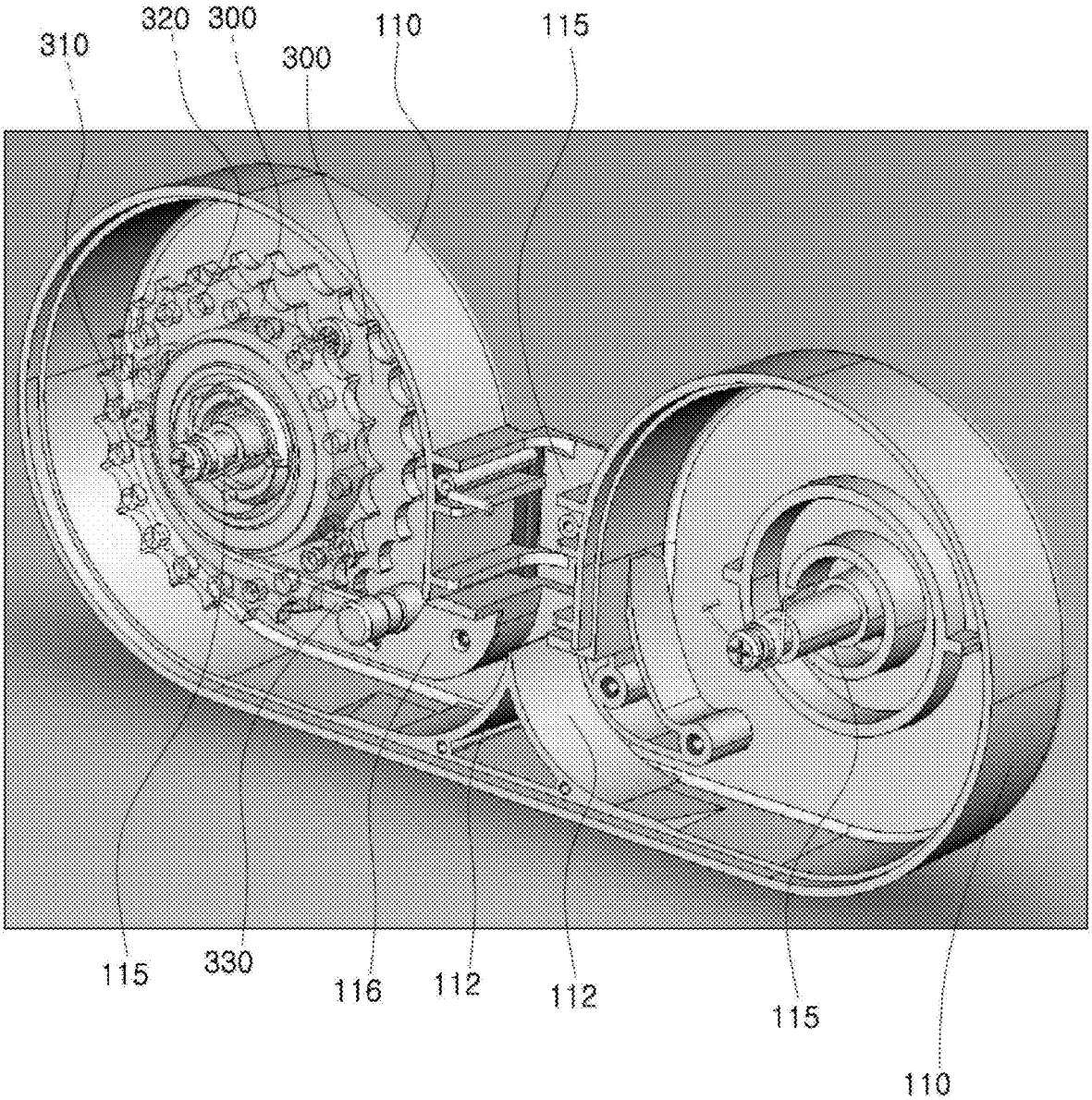
FIG. 7 is a perspective view of another example of a bullet-moving member installed inside the housing of the drum-type magazine according to an embodiment of the present invention.
Figure 8:
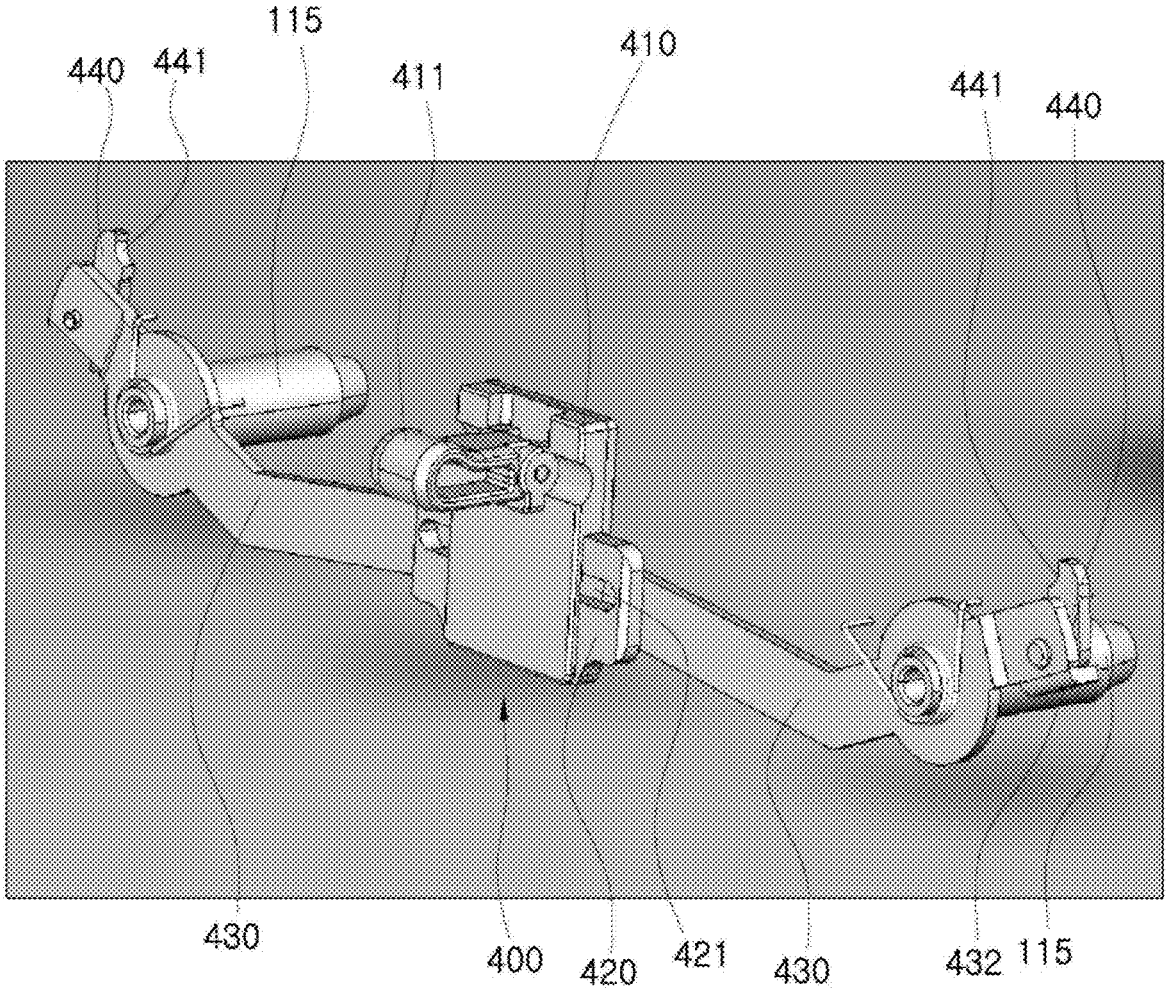
FIG. 8 is a perspective view of an operation member installed inside the housing of the drum-type magazine according to an embodiment of the present invention.
Figure 9:
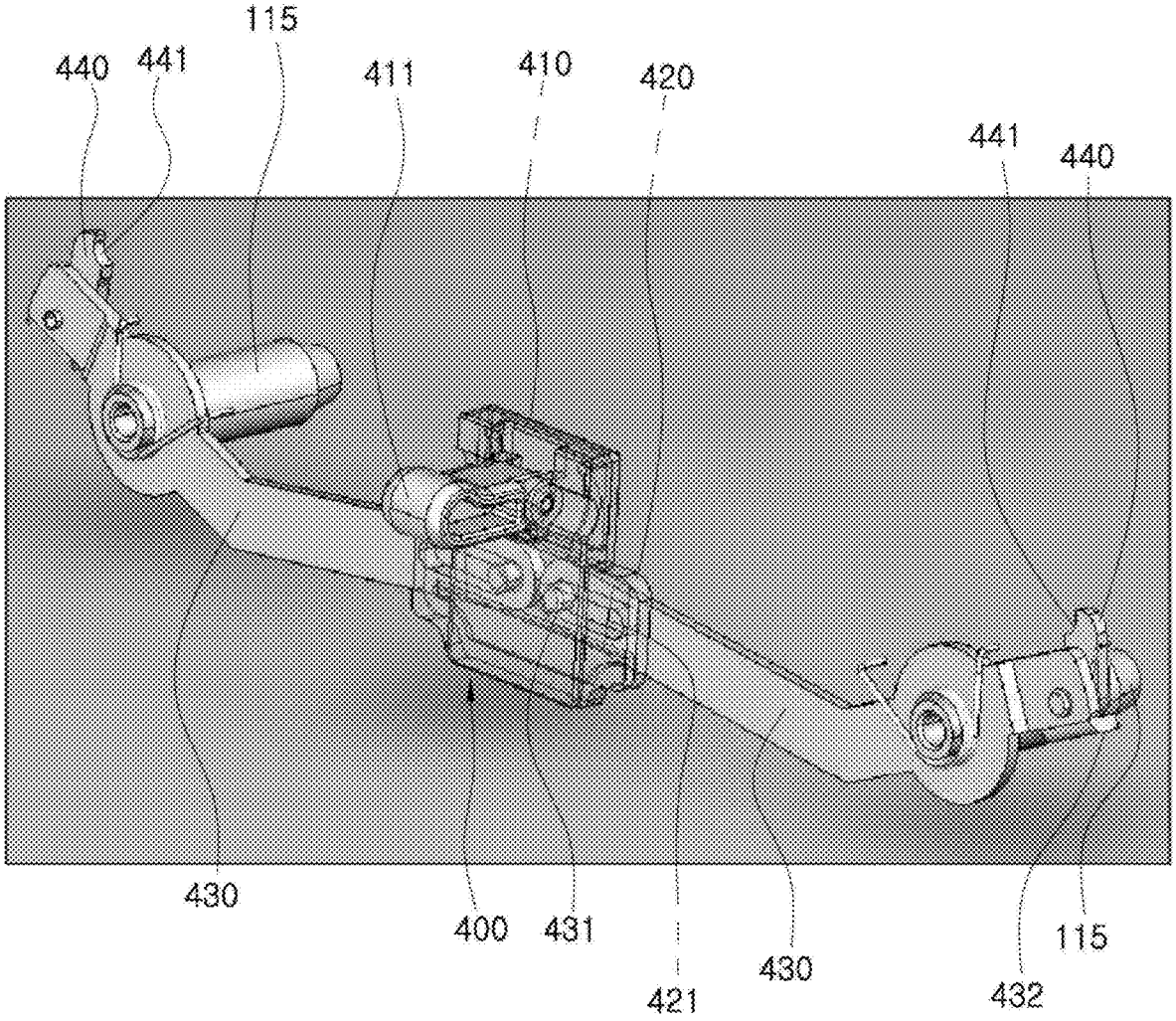
FIG. 9 is a perspective view of another example of an operation member installed inside the housing of the drum-type magazine according to an embodiment of the present invention.
Figure 10:
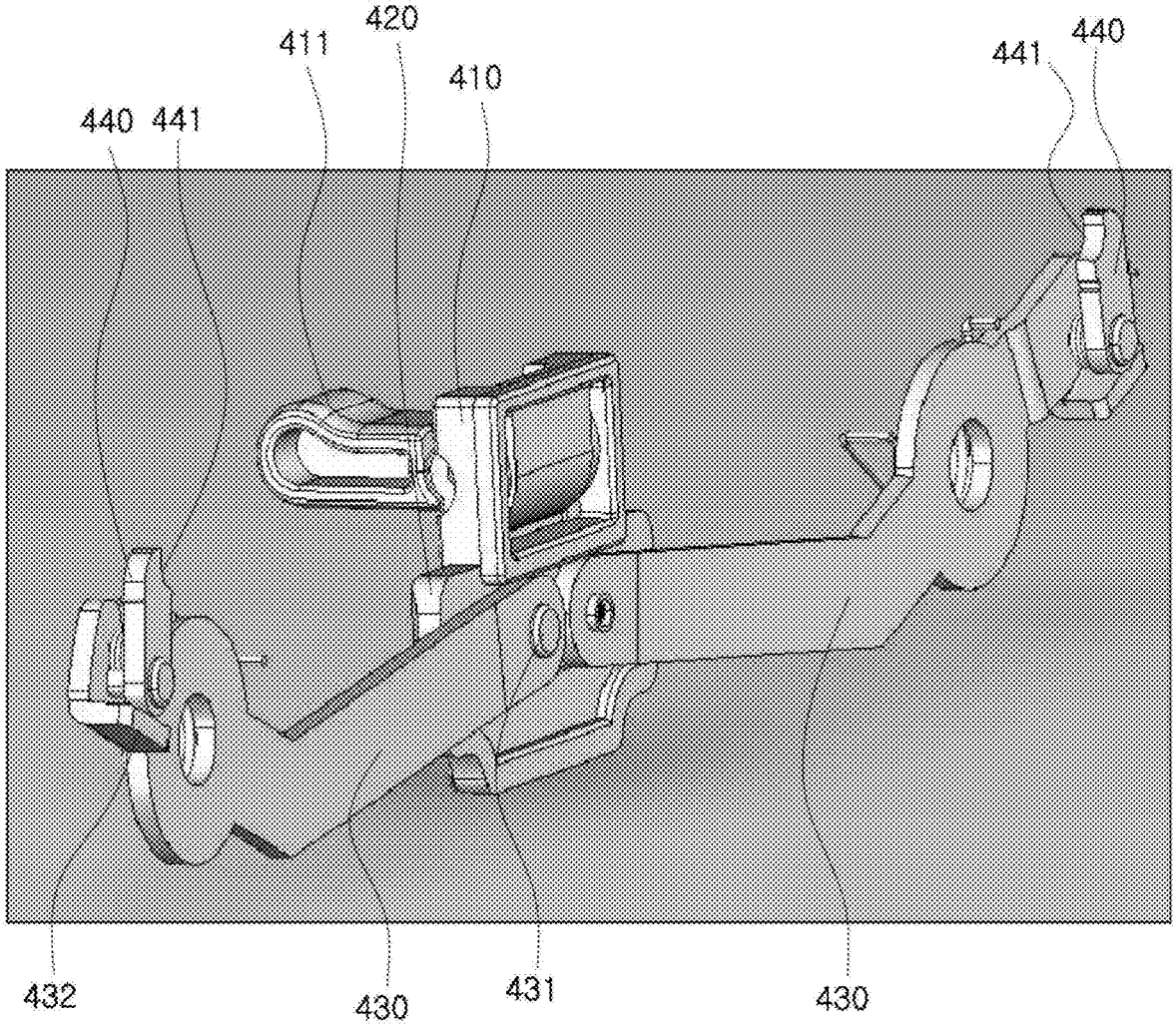
FIG. 10 is yet another perspective view of a further example of an operation member installed inside the housing of the drum-type magazine according to an embodiment of the present invention.
Figure 11:
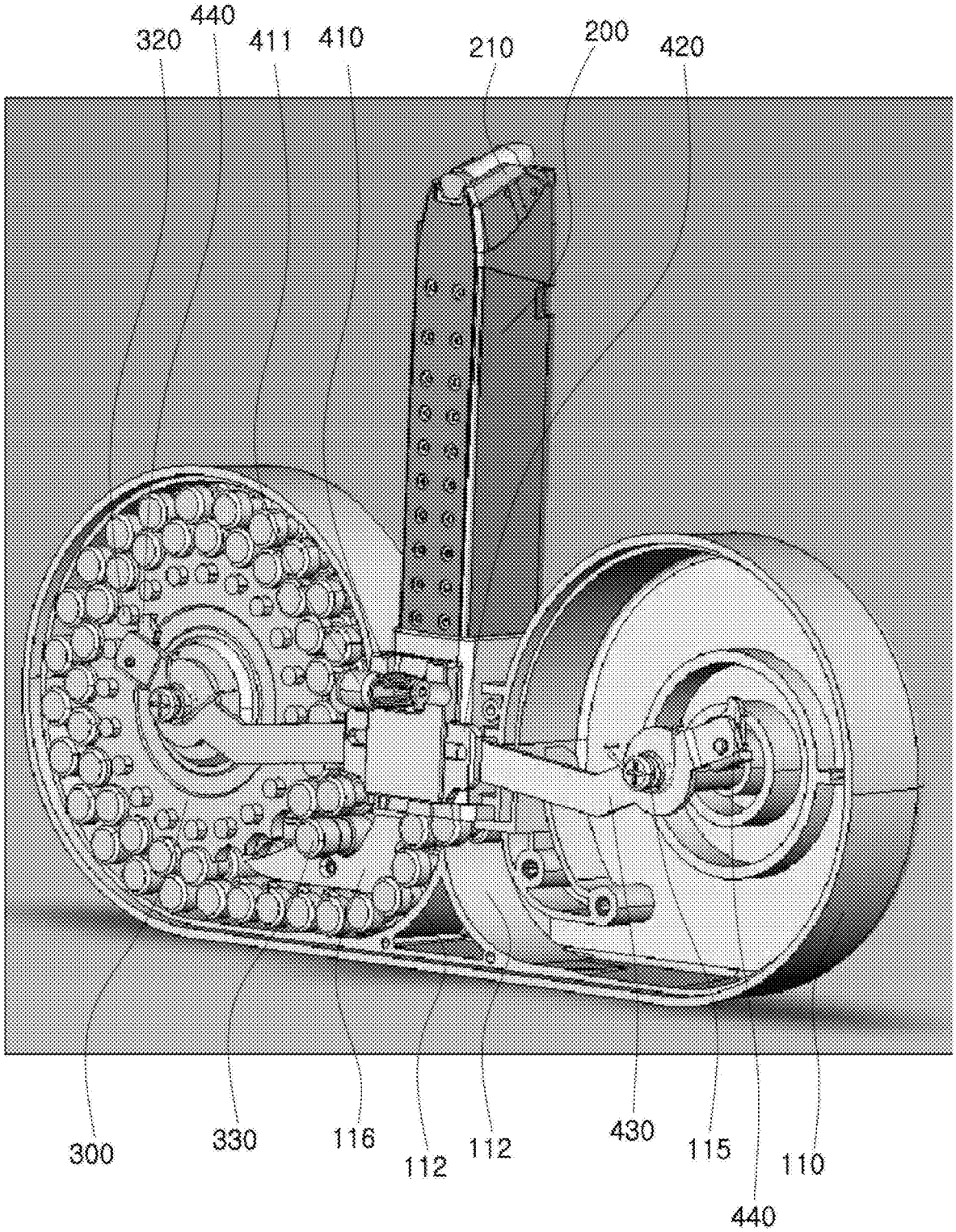
FIG. 11 is a perspective view illustrating a state in which bullets are installed inside the housing of the drum-type magazine according to an embodiment of the present invention.
Figure 12:
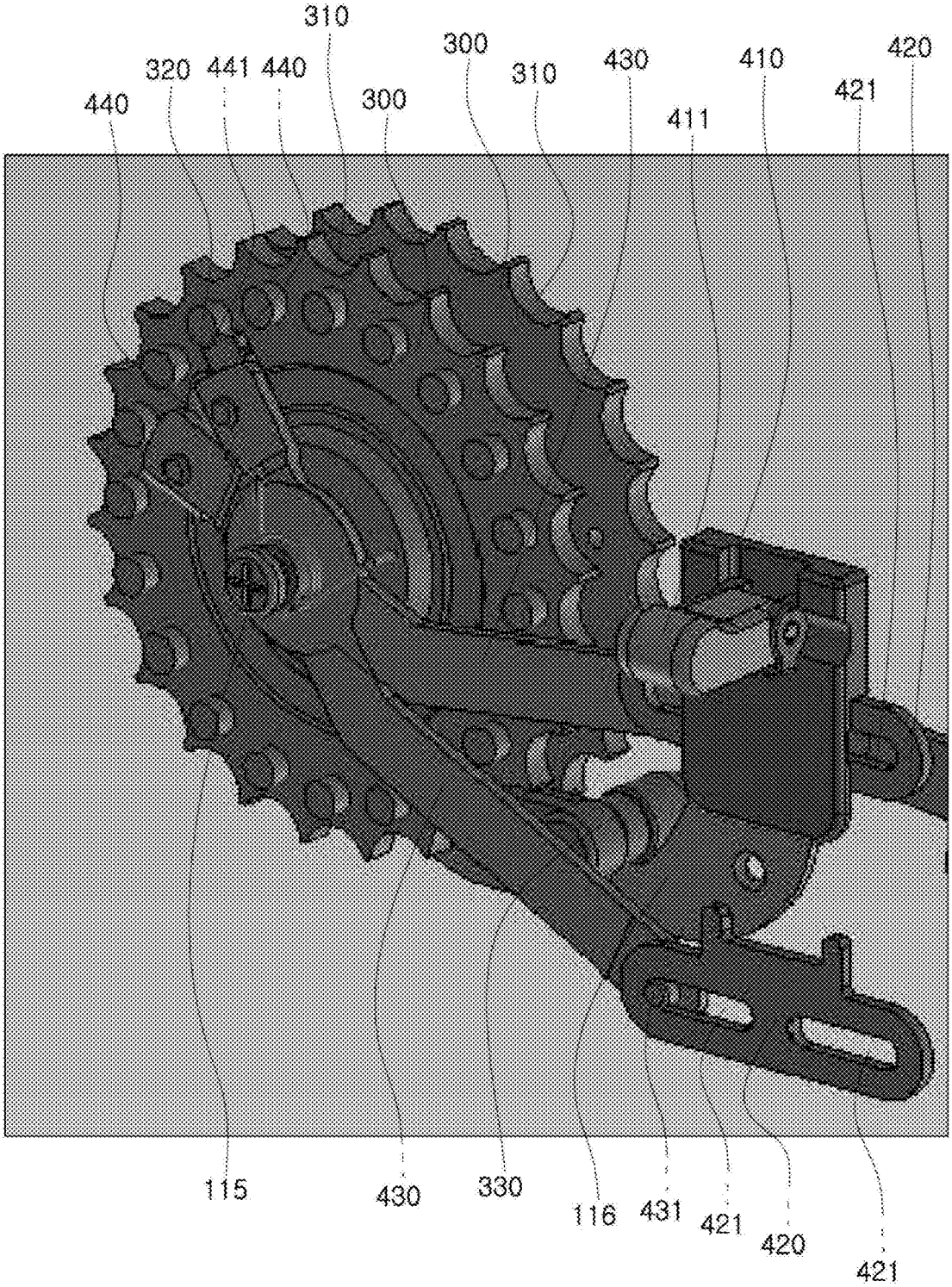
FIG. 12 is a perspective view of essential parts illustrating the operation process of the drum-type magazine according to an embodiment of the present invention.

Hereinafter, with reference to the attached drawings, the configuration and operation according to a preferred embodiment of the present invention will be described in detail.

Such embodiments of the present invention are to describe the present invention in detail such that those skilled in the art can implement the present invention easily, and the technical idea and scope of the present invention are not limited to the embodiments described herein.

In assigning reference numerals to components in each drawing, it shall be noted that like components have like reference numerals as much as possible even if illustrated in different drawings. Furthermore, the terms specifically defined in consideration of the configuration and operation of the present invention may be changed depending on the intention or practice of a user and an operator. The terms should be defined based on all contents in the specification.

Moreover, when a certain part "includes" a certain component, other components are not excluded unless explicitly described otherwise, and other components may in fact be included.

First, a drum-type magazine used in a small firearm according to an embodiment of the present invention can broadly include: a housing accommodating bullets; an insertion part provided on the housing and connected to a magazine fitting part of a firearm; a bullet-moving member moving the bullets accommodated in the housing to the insertion part; and an operation member used to easily insert bullets through the insertion part. Hereinafter, referring to the drawings, each component will be described in more detail.

The housing 100 includes: an insertion part 200 providing a storage space for holding bullets internally and providing space for storing bullets to supply the stored bullets to a firearm, and connected to a magazine fitting part of the firearm; a bullet-moving member 300 for moving the stored bullets to the insertion part 200; and an operation member 400 for rotating the bullet-moving member 300 in the reverse direction to insert the bullets through the top of the insertion part 200.

The housing 100 may include a rear cover 110 and a front cover 120 which is coupled to the rear cover 110 from the front. The rear cover 110 and the front cover 120 may be joined by a fastening component.

The rear cover 110 may include an insertion space 111 which is formed at the central portion thereof and has an inlet opened upwards, and a first storage space 113 and a second storage space 114 which are formed in an approximately circular shape and symmetrically arranged on both sides facing each other around the insertion space 111.

Additionally, arc-shaped bullet guide parts 112 are formed below the insertion space 111 of the rear cover 110 in a symmetrical manner, so that the bullets moved from the first storage space 113 and the second storage space 114 can be guided and moved along the respective bullet guide parts 112 and then can cross each other and be sequentially moved into the inside of the bottom of the insertion part 200 positioned within the insertion space 111.

Here, bullet-moving guides 116 respectively corresponding to the bullet guide parts 112 may be further provided above the spaced bullet guide parts 112 to ensure precise movement of the bullets along each bullet guide part 112.

Moreover, the front cover 120 is coupled to the front of the rear cover 110 and closes the first storage space 113, the insertion space 111, and the second storage space 114, thereby preventing the ingress of foreign substances into the housing 100, fixing the insertion part 200 installed inside the insertion space 111, and protecting the bullets stored in the first storage space 113 and the second storage space 114.

The front central part of the front cover 120 has an approximately rectangular operation hole 121 which has a predetermined length in a vertical direction and is perforated in the front surface of the central portion thereof. Through the operation hole 121, an operation lever 411 provided on a lifting portion 410 of the operation member 400, which will be described later, protrudes such that the operation lever 411 protruding through the operation hole 121 can move up and down along the operation hole 121.

Furthermore, an extension hole 122 communicating with the operation hole 121 may be further provided on the upper surface at the central portion of the front cover 120. The extension hole 122 is provided to prevent the operation hole 121 from interfering the rotation when the operation lever 411 moved upwards from the operation hole 121 rotates towards the insertion part 200.

Here, a partition wall 130 may be installed on the inner surface of the front cover 120 to prevent interference among the bullets stored in the first storage space 113 and the second storage space 114 of the rear cover 110, the bullet-moving member 300 and the front cover 120. The partition wall 130 may have through-holes 131 provided on both facing sides thereof. Since an operation rod 430 of the operation member 400 which will be described later is located between the front cover 120 and the partition wall 130 and an operation portion 440 installed at the end of the operation rod 430 is located on the front surface of the bullet-moving member 300, the operation rod 430 and the operation portion 440 can be connected with each other through the through-holes 430.

The insertion part 200 is installed in the insertion space 111 of the housing 100. The lower end of the insertion part 200 can be connected to the bullet guide part 112 while being inserted into the insertion space 111, and the upper end of the insertion part 200, exposed to the exterior of the housing 100, is inserted into the magazine fitting part of the firearm, allowing the bullets moving along the interior of the insertion part 200 to move into the firearm.

A passage for the movement of the bullets may be formed within the insertion part 200, and a fixing jaw 210 may be provided at the top of the insertion part 200 in an open state from front to rear to allow the bullet to be temporarily caught and fixed.

The length of the insertion part 200 may vary according to the firearm, and the interior passage can be configured differently based on the specifications of the bullets moving along the interior.

The bullets that can move through the insertion part 200 from the housing 100 may be 9 mm bullets typically used in various small firearms, such as general rifles or shoulder-fired rifles. If bullets with different specifications are required, the insertion part and the housing suitable for the movement of such bullets can be used.

The bullet-moving member 300 is a means for sequentially moving the bullets, which moved into the first storage space 113 and the second storage space 114 of the housing 10 through the insertion part 200, toward the insertion part 200.

The bullet-moving members 300 are formed in a pair, and can be installed in the first storage space 113 and the second storage space 114, respectively. In detail, the bullet-moving members 300 are formed in a disc form, and each may include an arc-shaped seating groove formed along the outer circumference thereof, allowing the bullets to be seated and moved in the seating grooves 310.

The bullet-moving members 300 are rotatably installed via rotational shafts 115 provided at the centers of the first storage space 113 and the second storage space 114 respectively. In this instance, the bullet-moving members 300 may be installed with elastic force applied in one rotational direction by elastic members, such as springs.

In other words, as the bullet-moving members 300 have an elastic force to rotate in the counterclockwise direction, the bullets seated in the seating grooves 310 of the bullet-moving members 300 move in the counterclockwise direction with elastic force, and then, travel into the insertion part 200 through the bullet guide parts 112. When the insertion part 200 is connected to the firearm, the bullets moved into the insertion part 200 are sequentially supplied to the firearm in use.

The bullet-moving members 300 are preferably configured as a pair of opposing discs. The pair of bullet-moving members 300 are rotatably installed on the rotational shafts 115, and maintain a predetermined distance to correspond to the length of the bullets used, so the seating grooves 310 of the pair of bullet-moving members 300 can each stably support both longitudinal sides of the bullet.

Additionally, each bullet-moving member 300 includes a plurality of operation protrusions 320 protruding on the front surface near the edge thereof at regular intervals in the circumferential direction around the rotational shaft. The operation protrusions 320 can be selectively connected with the operation portion 440 of the operation member 400, and the bullet-moving member 300 may rotate in the clockwise direction, opposite to the bullet movement direction, by the connected operation portion 440.

Additionally, a dummy bullet support 330 may be provided between the pair of bullet-moving members 300. One end of the dummy bullet support 330 is fixed to the inner edge of one of the pair of bullet-moving members 300, and the other end of the dummy bullet support 330 extending from the one end is formed in an approximately L-shape with a rounded corner instead of an angled corner. The end of the dummy bullet support 330 getting out of the pair of bullet-moving members 300 maintains a horizontal state, such that the other end of the dummy bullet support 330 can move the bullets including dummy bullets in the counterclockwise direction depending on the rotation of the bullet-moving members 300. In this instance, the other end of the dummy bullet support 330 can have the shape of the dummy bullet to be in stable contact with the dummy bullet.

The operation member 400 slightly rotates the bullet-moving members 300, which tend to rotate counterclockwise with elastic force, in the clockwise direction by force to retreat the bullet located at the fixing jaw 210 of the top of the insertion part 200 inwards, thereby allowing the insertion of a new bullet into a space which is formed at the fixing jaw 210 of the top of the insertion part 200.

The operation member 400 may include, as an example: a lifting portion 410 having an operation lever 411 at the front; a long-hole bracket 420 installed at a lower portion of the lifting portion 410; a pair of operation rods 430 of which one side is connected to both edges of the long-hole bracket 420 and the other side is connected to the rotational shaft 115 with elastic force; and operation portions 440, each rotatably installed on a portion extending from the other side end of each operation rod 430 with elastic force to push the operation protrusion 320 by being selectively connected with the operation protrusion 320 of the bullet-moving member 300 depending on the descending of the lifting portion 410, thereby rotating the bullet-moving member in the clockwise direction.

Specifically, the lifting portion 410 is located in front of the bottom of the insertion part 200 inside the housing 100 and installed to be vertically lifted, and includes the operation lever 411 protruding on the front surface thereof. The operation lever 411 may protrude outwards through the operation hole 121 of the front cover 120.

In addition, the long-hole bracket 420 is installed on the bottom inner surface of the lifting portion 410, long holes 421 may be respectively formed on both opposing sides of the long-hole bracket 420.

Additionally, the operation rods 430 are configured as a pair, with one end of each connected to the long hole 421 of the long-hole bracket 420. Each operation rod 430 has a connection pin 431 formed on the front surface of one side thereof, and one side of the operation rod 430 can be movably and rotatably installed inside the long hole 421 of the long-hole bracket 420 through the connection pin 431.

The other side of each operation rod 430 is rotatably installed on the rotational shaft 115, is elastically installed by an elastic member, such as a spring. When the lifting portion 410 is lowered using the operation lever 411, one side of the operation rod 430 moves downward, and the other side of the operation rod 430 can be elastically moved around the rotational shaft 115. When the lifting portion 410 returns, the other side of the operation rod 430 is reversely rotated around the rotational shaft 115 by the restoring elastic force, thus returning to the original state.

Moreover, the operation portion 440 can be rotatably installed with elastic force by the spring inside the end extending from the other side of each operation rod 430.

Accordingly, in the state in which the lifting portion 410 is in the raised position, the operation portion 440 is spaced apart from the operation protrusion 320 annularly protruding from the front of the bullet-moving member 300 not to interfere the counterclockwise rotation of the bullet-moving member 300. When the lifting portion 410 is lowered, the operation portion 440 is connected to the operation protrusion 320 of the adjacent bullet-moving member 300 by the rotation of the operation rod 430 and rotated with elastic force. When the operation portion 440 is caught to a rotation prevention jaw 432 provided at the other side end of the operation rod 430, the rotation of the operation portion 440 is stopped. The continuous rotation of the operation rod 430 and the operation portion 440 pushes the operation protrusion 320, so the bullet-moving member 300 rotates in the clockwise direction.

As described above, when the bullet-moving member 300 rotates in the clockwise direction, the bullet which moved to the top of the insertion part 200 by the counterclockwise rotation of the bullet-moving member 300 is retreated somewhat to create a space at the top of the insertion part 200, thereby allowing a user to simply insert a new bullet into the space.

In addition, when the lifting portion 410 returns to the original position, the operation rod 430 rotates back to its original state and the operation portion 440, which was rotating with elastic force, is separated from the operation protrusion 320 and returns to its original position by elastic restoring force.

Here, the operation protrusion 320 may be cylindrical, and the end of the operation portion 440 may have an arc-shaped grip groove 441 formed on one offset side and a rounded shape formed on the other side, so the operation portion 440 does not interfere with the operation protrusion 320 when the operation portion 440 rotates counterclockwise, and the outer periphery of the operation protrusion 320 can be accurately grasped onto the grip groove 441 only when the operation portion 440 is rotated in the clockwise direction.

Moreover, the operation rod 430 may be positioned between the front cover 120 and the partition wall 130 to prevent interference with bullets. It is preferable for the operation portion 440 connected to the operation rod 430 to be installed near the operation protrusion 320 of the bullet-moving member 300 through the through-hole 131 formed in the partition wall 130.

Furthermore, the operation lever 411, when installed on the front surface of the lifting portion 410, may be horizontally installed at a right angle to the vertical plane of the lifting portion 410 to facilitate the lowering of the operation lever 411. However, in this case, as maintaining the externally protruding state, the operation lever 411 may be unnecessarily operated or become easily broken or damaged.

Therefore, the operation lever 411 can be rotatably installed on the front surface of the lifting portion 410 to be folded or unfolded by using a hinge or similar mechanism. For instance, the operation lever 411 can be configured to be folded or unfolded within a range of a right angle, so the operation lever 411 is in close contact with the front surface of the insertion part 200 when folded upward, and maintains a right angle to the vertical plane of the lifting portion 410 when unfolded downward.

Additionally, the operation lever 411 may have a spring installed on the hinge, so is configured to maintain the folded state normally, to be unfolded with elastic force when external force is applied, and to be folded by restoring force when the external force is removed.

Moreover, a rotation-preventing jaw may be formed on the front surface of the lifting portion 410 to prevent further rotation beyond the horizontal state at a right angle to the front surface of the lifting portion 410 when the operation lever 411 is unfolded.

The usage process of the drum-type magazine used in the small firearm according to the present invention will be described as follows.

First, a plurality of dummy bullets, each having a predetermined length and linked together in succession, are pre-installed within the insertion part 200. The plurality of dummy bullets may extend from the end of the insertion part 200 to the central bottom of the bullet-moving member 300 through the bullet guide part 112.

At this time, the dummy bullets pre-inserted into the insertion part 200 are supported by the dummy bullet support 330 connected to the bullet-moving member 300, which rotates counterclockwise with elastic force, and moved toward the insertion part 200. So, the dummy bullets are positioned within the insertion part 200 under elastic force, and the first dummy bullet among the dummy bullets is caught on the fixing jaw 210 at the top of the insertion part 200.

In this state, when a bullet is inserted into the housing 100 through the insertion part 200, the present invention enables the bullet to be inserted without forcibly pushing the bullet against the resistive dummy bullets with elastic force or using a separate loader. That is, when the lifting portion 410 is lowered by the operation lever 411 of the operation member 400, one side of the operation rod 430 connected to the long-hole bracket 420 of the lifting portion 410 is lowered together, so the other side of the operation rod 430 rotates around the rotational shaft 115.

Furthermore, as described above, when the other side of the operation rod 430 is rotated, the operation protrusion 320 of the bullet-moving member 300 is caught to the grip groove 441 of the operation portion 440, which is rotatably installed with elastic force at the other side of the operation rod 430. The continuously rotating operation portion 440 is not further rotated by being caught to the rotation prevention jaw provided on the other side of the operation rod 430, the operation protrusion 320 pushes the operation portion 440, and then, the bullet-moving member 300 rotates in the clockwise direction.

As described above, when the bullet-moving member 300 rotates in the clockwise direction, the dummy bullet support 330 connected to the bullet-moving member 300 also rotates, causing the dummy bullet caught on the fixing jaw 210 at the top of the insertion part 200 to retreat inward. Thus, the space is formed at the top of the insertion part 200, allowing the user to easily push the bullet into the space.

In addition, after the bullet is pushed into the insertion part 200, when the external force is removed from the lowering operation lever 411, the lifting portion 410 is returned to its original position. As one side of the lifting portion 410 and the operation rod 430 rise, the other side of the operation rod 430 rotates in the opposite direction. According, the operation protrusion 320 of the bullet-moving member 300 is disengaged from the grip groove 441 of the operation portion 440, and the operation portion 440 is returned to its original state.

Then, the bullet-moving member 300 resumes its counterclockwise rotation due to the elastic force, so the dummy bullet support 330 is also rotated to push the dummy bullets back upward. The bullet previously inserted into the insertion part 200 is pushed up to the top of the insertion part 200 and elastically caught on the fixing jaw 210.

In the above state, when another bullet is inserted into the insertion part 200, the aforementioned method is repeated. SO, when the operation member 400 is actuated, the bullet located at the top of the insertion part 200 is moved downward to create a space again, and is inserted into the space. When the process of making the operation member 400 return to the original state is repeated, a large number of bullets can be easily loaded into the first storage space 113 and the second storage space 114.

As described above, when all of the bullets are loaded in the first storage space 113 and the second storage space 114, approximately 100 bullets can be loaded in the case of 9 mm bullets. However, the number of bullets loaded may vary depending on the size of the first storage space 113 and the second storage space 114, the length of the insertion part 200, and the type of bullets.

In addition, when the user inserts the insertion part 200 into the magazine fitting part of the firearm and operates the firearm after fully loading bullets in the first storage space 113 and the second storage space 114, the bullet positioned at the top of the insertion part 200 moves into the chamber, and at the same time, the bullet-moving member 300 rotates in the counterclockwise direction. Then, the next bullet is moved to the top of the insertion part 200 by the pushing force exerted by the dummy bullet support 330 rotating with the bullet-moving member 300. Accordingly, bullets loaded in the first storage space 113 and the second storage space 114 can be sequentially moved one by one as the firearm is used.

As described above, while specific embodiments of the present invention have been detailed, it is, of course, possible to make various modifications without departing from the scope of the disclosed content. Therefore, the scope of the disclosed content should not be limited to the described embodiments but should be determined by the following claims as well as equivalents to those claims.

What is claimed is:

1. A drum-type magazine used in a firearm comprising:

a housing which includes a rear cover, which has an insertion space formed at the central portion thereof and having an inlet formed upward, a pair of bullet guide parts formed below the insertion space, and a first storage space and a second storage space symmetrically formed on both sides facing each other around the insertion space, and a front cover, which is coupled in front of the rear cover to enclose the insertion space, the first storage space, and the second storage space, and has an operation hole penetrating through the central portion thereof;

an insertion part of which an open lower end is inserted into the insertion space and connected to the bullet guide parts, and which is inserted into a magazine fitting part of the firearm in a state in which bullets are temporarily held to the top of the insertion part;

a pair of bullet-moving members, each of which is rotatably installed with elastic force on a rotational shaft formed at the center of the first storage space and the second storage space, has seating grooves sequentially formed along the outer circumference thereof to allow bullets to be seated, and moves the bullets into the insertion part through the bullet guide part by a rotation in a first direction; and an operation member which includes a lifting portion, which is located in front of a bottom of the insertion part, installed to move up and down, and has an operation lever passing through the operation hole and installed on a front surface thereof, a long-hole bracket, which is installed at a lower portion of the lifting portion and has long holes formed at both facing sides thereof, a pair of operation rods, each of which has one side having a connection pin provided to be rotatably connected to a respective long hole of the long-hole bracket and another side rotatably connected to a respective rotational shaft with elastic force to be rotated depending on an ascending of the lifting portion, and a pair of operation portions, which are installed inside an extended portion of the another side of each operation rod to rotate at a predetermined angle with elastic force to push one of a plurality of operation protrusions annularly protruding at regular intervals around each rotational shaft on a front surface of each bullet-moving member depending on a descending of the lifting portion to rotate the bullet-moving members in a second direction opposite the first direction.

2. The drum-type magazine used in a firearm according to claim 1, wherein a partition wall is installed between the front cover and the rear cover, and through-holes are formed on both facing sides of the partition wall.

3. The drum-type magazine used in a firearm according to claim 1, wherein inside the housing, a plurality of dummy bullets, which extend from a top of an interior of the insertion part to a central bottom of each bullet-moving member through each bullet guide part, and are linked together, are installed in pairs, in the first storage space and the second storage space, respectively.

4. The drum-type magazine used in a firearm according to claim 1, wherein bullet-moving guides are provided above the spaced bullet guide parts respectively.

5. The drum-type magazine used in a firearm according to claim 1, wherein each operation protrusion protrudes in a cylindrical shape, and each operation portion has an arc-shaped grip groove formed at an end thereof to allow for gripping of an outer periphery of a respective operation protrusion, and each operation rod has a rotation prevention jaw provided at an end of the extended portion of the another side thereof to prevent excessive rotation of a respective operation portion.

6. The drum-type magazine used in a firearm according to claim 1, wherein each bullet-moving member is configured as a pair of members facing each other and spaced apart on a respective rotational shaft.

7. The drum-type magazine used in a firearm according to claim 6, wherein a dummy bullet support is provided between a pair of bullet-moving members configured as a pair facing each other and spaced apart on a respective rotational shaft, wherein one end of the dummy bullet support is fixed to the inner surface of one of the pair of bullet-moving members, and another end extending in an arc shape extends out of the spaced bullet-moving members and is configured to be in a horizontal state.

8. The drum-type magazine used in a firearm according to claim 1, wherein the operation lever is hinge-connected to a front surface of the lifting portion to allow folding and unfolding.

9. The drum-type magazine used in a firearm according to claim 8, wherein the operation lever is folded and unfolded within a range of a right angle, such that when folded upward, the operation lever is positioned toward the front of the insertion part, and when unfolded downward, the operation lever maintains the horizontal state while maintaining a right angle relative to a vertical plane of the lifting portion.

* * * * *